US010570730B2

(12) United States Patent
Santarelli

(10) Patent No.: US 10,570,730 B2
(45) Date of Patent: Feb. 25, 2020

(54) HYDROCARBON FILLED FRACTURE FORMATION TESTING BEFORE SHALE FRACTURING

(71) Applicant: Geomec Engineering Ltd., London (GB)

(72) Inventor: Frederic Joseph Santarelli, Stavanger (NO)

(73) Assignee: GEOMEC ENGINEERING LIMITED, London (GB)

( * ) Notice: Subject to any disclaimer, the term of this patent is extended or adjusted under 35 U.S.C. 154(b) by 141 days.

(21) Appl. No.: 15/576,832

(22) PCT Filed: Jun. 2, 2016

(86) PCT No.: PCT/GB2016/051624
§ 371 (c)(1),
(2) Date: Nov. 26, 2017

(87) PCT Pub. No.: WO2016/193732
PCT Pub. Date: Dec. 8, 2016

(65) Prior Publication Data

US 2018/0306029 A1 Oct. 25, 2018

(30) Foreign Application Priority Data

Jun. 3, 2015 (GB) ..... 1509576.3
Jun. 3, 2015 (GB) ..... 1509579.7
Aug. 3, 2015 (GB) ..... 1513655.9

(51) Int. Cl.
*E21B 43/26* (2006.01)
*E21B 43/267* (2006.01)
(Continued)

(52) U.S. Cl.
CPC ..... *E21B 49/00* (2013.01); *E21B 43/26* (2013.01); *E21B 43/267* (2013.01); *E21B 47/06* (2013.01);
(Continued)

(58) Field of Classification Search
CPC ..... E21B 49/00; E21B 43/26; E21B 43/267; E21B 47/06; E21B 47/065; E21B 33/12; E21B 43/11; E21B 43/14
See application file for complete search history.

(56) References Cited

U.S. PATENT DOCUMENTS 2,952,449 A 9/1960 Bays
3,285,342 A 11/1966 Cronberger
(Continued)

FOREIGN PATENT DOCUMENTS

CA 2013726 A1 10/1990
CA 2240580 C 1/2001
(Continued)

OTHER PUBLICATIONS

EPO as Int'l Search Authority; International Search Report for PCT/GB2016/051621; dated Sep. 12, 2016; entire document; Rijswijk, The Netherlands.
(Continued)

*Primary Examiner* — Silvana C Runyan
(74) *Attorney, Agent, or Firm* — Law Office Of Jesse D. Lambert, LLC

(57) ABSTRACT

A method of determining the presence of hydrocarbon-filled natural fractures with sufficient lateral extension in a well in which stimulation by hydraulic fracturing is intended to be carried out. Following perforation of an interval, a fluid is pumped into the well and a pressure response trace is collected. The fluid is pumped at a rate which is lower than the pump rate for the intended frac job and the data collec-
(Continued)

tion rate is higher than the data collection rate for the intended frac job. Characteristic elements are identified in the pressure response trace whose value and combination indicate the presence or absence of hydrocarbon-filled natural fractures with sufficient lateral extension in the interval.

16 Claims, 7 Drawing Sheets

(51) Int. Cl.

| | |
|---|---|
| ***E21B 49/00*** | (2006.01) |
| ***E21B 47/06*** | (2012.01) |
| *E21B 33/12* | (2006.01) |
| *E21B 43/11* | (2006.01) |
| *E21B 43/14* | (2006.01) |

(52) U.S. Cl.
CPC ..... *E21B 47/065* (2013.01); *E21B 33/12* (2013.01); *E21B 43/11* (2013.01); *E21B 43/14* (2013.01)

(56) References Cited

U.S. PATENT DOCUMENTS

| | | | | |
|---|---|---|---|---|
| 3,501,201 | A | 3/1970 | Clossman et al. | |
| 4,549,608 | A | 10/1985 | Stowe et al. | |
| 4,660,643 | A | 4/1987 | Perkins | |
| 4,802,144 | A | 1/1989 | Holzhausen et al. | |
| 4,834,181 | A | 5/1989 | Uhri et al. | |
| 4,858,130 | A * | 8/1989 | Widrow | E21B 43/26 702/11 |
| 5,070,457 | A | 12/1991 | Poulsen | |
| 5,170,378 | A | 12/1992 | Mellor et al. | |
| 8,978,764 | B2 | 3/2015 | Dusseault et al. | |
| 2006/0201674 | A1 | 9/2006 | Soliman et al. | |
| 2007/0083331 | A1 | 4/2007 | Craig | |
| 2012/0267096 | A1 | 10/2012 | Pershikova | |
| 2013/0197810 | A1 | 8/2013 | Haas et al. | |
| 2014/0058686 | A1 * | 2/2014 | Anderson | E21B 43/26 702/51 |
| 2014/0238668 | A1 | 8/2014 | Bittleston et al. | |
| 2014/0299318 | A1 | 10/2014 | Crews et al. | |
| 2015/0068746 | A1 | 3/2015 | Abass et al. | |
| 2015/0075787 | A1 * | 3/2015 | Davidson | E21B 49/008 166/254.1 |
| 2015/0129211 | A1 | 5/2015 | Dusseault et al. | |
| 2017/0075006 | A1 * | 3/2017 | Dusterhoft | G01V 1/303 |
| 2017/0123089 | A1 * | 5/2017 | Walters | E21B 43/26 |
| 2017/0205531 | A1 * | 7/2017 | Berard | G01V 11/00 |

FOREIGN PATENT DOCUMENTS

| | | | |
|---|---|---|---|
| EP | 2527586 | A1 | 11/2012 |
| EP | 2700785 | A2 | 2/2014 |
| GB | 2050467 | A | 1/1981 |
| GB | 2231405 | A | 11/1990 |
| WO | 2008004172 | A2 | 1/2008 |
| WO | 2008093264 | A1 | 8/2008 |
| WO | 2009086279 | A2 | 7/2009 |
| WO | 2012068397 | A2 | 5/2012 |
| WO | 2014004611 | A2 | 1/2014 |
| WO | 2014022587 | A2 | 2/2014 |
| WO | 2014055273 | A1 | 4/2014 |
| WO | 2016069114 | A1 | 5/2016 |

OTHER PUBLICATIONS

EPO as Int'l Search Authority; Written Opinion of the Int'l Searching Authority for PCT/GB2016/051621; dated Sep. 12, 2016 (est.); entire document; Munich, Germany.

Intellectual Property Office of the UK Patent Office; Search Report for GB1509579.7; dated Sep. 14, 2015; entire document; United Kingdom.

EPO as Int'l Search Authority; International Search Report for PCT/GB2016/051625; dated Sep. 9, 2016; entire document; Rijswijk, The Netherlands.

EPO as Int'l Search Authority; Written Opinion of the Int'l Searching Authority for PCT/GB2016/051625; dated Sep. 9, 2016 (est.); entire document; Munich, Germany.

Intellectual Property Office of the UK Patent Office; Search Report for GB1513655.9; dated Jan. 31, 2016; entire document; United Kingdom.

Society of Petroleum Engineers; SPE 24824, "Fracture Measurement Using Hydraulic Impedance Testing"; Oct. 4-7, 1992; entire document; Washington, D.C., US.

Society of Petroleum Engineers; SPE/ISRM 47329, "Sand Production on Water Injectors: Just How Bad Can it Get?"; Jul. 8-10, 1996; entire document; Trondheim, Norway.

EPO as Int'l Search Authority; International Search Report for PCT/GB2016/051624; dated Sep. 9, 2016; entire document; Rijswijk, The Netherlands.

EPO as Int'l Search Authority; Written Opinion of the Int'l Searching Authority for PCT/GB2016/051624; dated Sep. 9, 2016 (est.); entire document; Munich, Germany.

Intellectual Property Office of the UK Patent Office; Search Report for GB1509576.3; dated Sep. 7, 2015; entire document; United Kingdom.

* cited by examiner

HYDROCARBON FILLED FRACTURE FORMATION TESTING BEFORE SHALE FRACTURING

The present invention relates to the extraction of hydrocarbons by hydraulic fracturing in shale formations and more particularly, to a method of determining the presence of hydrocarbon-filled natural fractures i.e. sweet spots at intervals along the drain length of the completed well.

There is now a sustained interest in so-called unconventional resources to meet our energy needs. As a result, techniques have been developed to stimulate the production of hydrocarbons from low-permeability sub-surface formations such as shale, marl, siltstone, etc. In a typical arrangement a well is drilled providing a horizontal leg through a known shale formation below the cap rock. The well is then perforated and stimulated at intervals along the drain length. Stimulation is undertaken by pumping a mixture of water, chemicals and proppant at a high rate and pressure into the formation at a perforated interval. The aim of this frac job is to cause natural fractures in the rock to open. The role of the proppant (sand, ceramic, resin coated or not, etc.) is to keep the fractures open when stimulation is complete. In a typical well there may be up to 50 perforated and stimulated intervals with the intervals being up to 100 m apart (30 stages can be considered an average).

In the stimulation process, if naturally occurring hydrocarbon-filled fractures are present at an interval, these can be produced. However, the production from each interval can vary greatly. This is in part due to the fact that while fracture traces can be identified at the well bore wall by logging, such logs do not indicate the lateral extension of the fractures and it is the lateral extensions which determine the hydrocarbon production capacity. It is presently estimated that around 50% of intervals which are stimulated do not produce any hydrocarbons due primarily to the lack of naturally occurring hydrocarbon-filled fractures with sufficient lateral extension at the interval.

It is estimated that the cost in chemicals and proppant to perform a frac job to stimulate each interval is around 25,000 USD. Consequently, stimulating a single well at 40 intervals costs an operator around one million dollars in product costs. This represents a significant amount of the estimated drilling (three million dollars) and stimulation (three million dollars) costs for each well. If half the intervals do not produce hydrocarbons half a million dollars is wasted in costs which provide no return. This can represent around 20% to 30% of the completion cost of a well.

It is an object of the present invention to provide a method of determining the presence of hydrocarbon-filled natural fractures with sufficient lateral extension at an interval in a completed well so that in the absence of hydrocarbon-filled natural fractures with sufficient lateral extension the work can move to another interval saving the time and costs in performing a frac job which will not result in hydrocarbon production.

According to a first aspect of the present invention there is provided a method of determining the presence of hydrocarbon-filled natural fractures of significant lateral extension in a well in which stimulation by hydraulic fracturing is to be carried out, the method comprising the steps:

(a) on exposure of a formation at a first interval before an intended frac job is carried out, pumping a first fluid at a first rate into the well;

(b) collecting a pressure response trace at a first data collection rate;

(c) from the pressure response trace determining the presence of hydrocarbon-filled natural fractures with sufficient lateral extension at the first interval;

characterised in that:

(d) the first rate is lower than a pump rate of the intended frac job; and (e) the first data collection rate is higher than a data collection rate of the intended frac job.

By collecting pressure response data at a high data acquisition rate over a low pump rate, characteristic elements can be identified in the pressure response trace, which indicate the presence or absence of hydrocarbon-filled natural fractures with sufficient lateral extension. These natural fractures will travel from the wellbore into the formation by a distance sufficient to provide a fracture volume of significant capacity for hydrocarbon production.

Preferably, the method includes the step of aborting the intended frac job and plugging the first interval when hydrocarbon-filled natural fractures with sufficient lateral extension are not identified. In this way, the costs and time in performing a non-hydrocarbon producing frac job are saved.

Alternatively, the method includes the step of performing the intended frac job when hydrocarbon-filled natural fractures with sufficient lateral extension are identified as being present. In this way, the frac job will be known to produce hydrocarbons.

Preferably, the pressure response trace is collected at a gauge located at the wellhead. Preferably also, the first rate is measured by a gauge at the wellhead. In this way, as pressure and rate are typically measured at the wellhead, the method merely requires collection of the data at the wellhead gauges to be achieved at a higher frequency and thus no additional well intervention is required over that which is needed to perform the intended frac job.

Preferably, the pressure response trace comprises one or more characteristic elements, the presence and combination of the characteristic elements being used to determine the presence of hydrocarbon-filled natural fractures with sufficient lateral extension at the first interval.

Preferably, the first fluid is pumped at the first rate through a high pressure accurate low rate pump. This will necessitate the use of a specialised pump as those currently used for frac jobs cannot operate at the high pressure accurate low rate required. However, only one or two pumps will be required as compared to the 30 to 50 typically needed for the frac job.

Preferably, the first rate is less than 10 bpm (barrels per minute). The first rate may be less than 2 bpm. More preferably, the first rate is less than 1 bpm. In this way, the formation does not encounter shock on pumping and the pressure response trace will provide a more accurate indication of the response from the formation. Pump rates for frac jobs are typically in the range of 50 to 200 bpm as it is intended to shock the formation to open up the fractures.

Preferably, the first data collection rate is at 1 Hz. In this way a data point on the pressure response trace can be collected every second. More preferably, the data collection rate is between 1 and 10 Hz. The data collection rate may be between 10 and 100 Hz. As most gauges are now digital, such data collection rates are available but not used on the basis of the excessive quantity of data which would be collected over the time scales typically used in the industry.

Preferably, the first rate is held constant for a given time period. The time period is preferably set to obtain a sufficient length of trace to show the characteristic elements while limiting the volume of fluid pumped into the well to preferably be between 10 and 100 barrels.

Preferably, the method includes the step of determining the quality of the barriers on either side of the exposed formation at the first interval. Preferably, this step is determined by analysis of the pressure response trace. In this way, the quality of the barriers i.e. typically cement which is perforated to expose the formation, can be determined to verify that they are of good enough quality to sustain the intended frac job.

Preferably, the method is repeated at further intervals along the drain length of the well.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in some Figures, may be inclined. This is known in the art of horizontal wells and in particular for shale formations.

Embodiments of the present invention will now be described, by way of example only, with reference to the accompanying Figures, of which:

Figure 1:
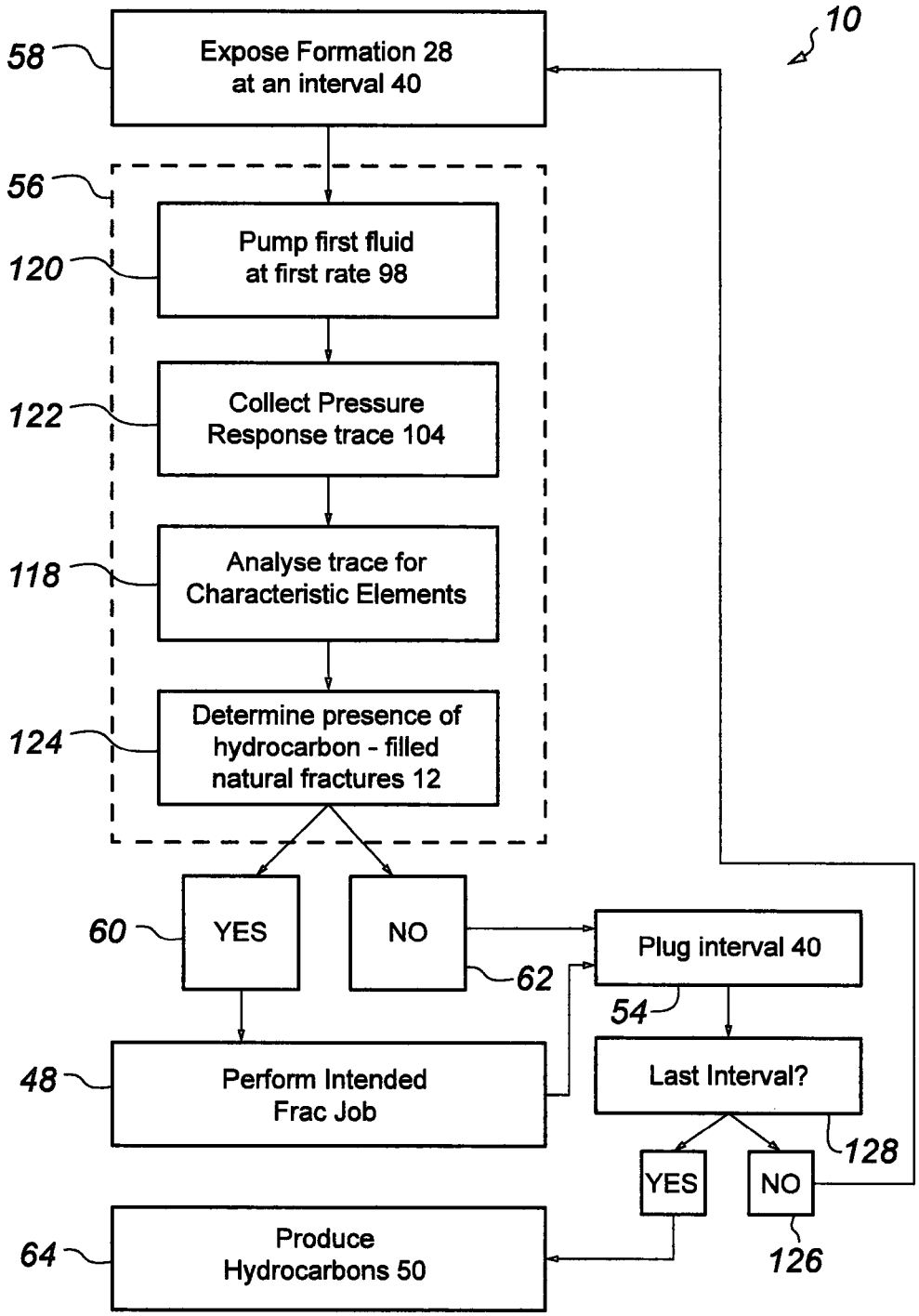
FIG. 1 is a flow chart of a methodology according to an embodiment of the present invention.
Figure 2:
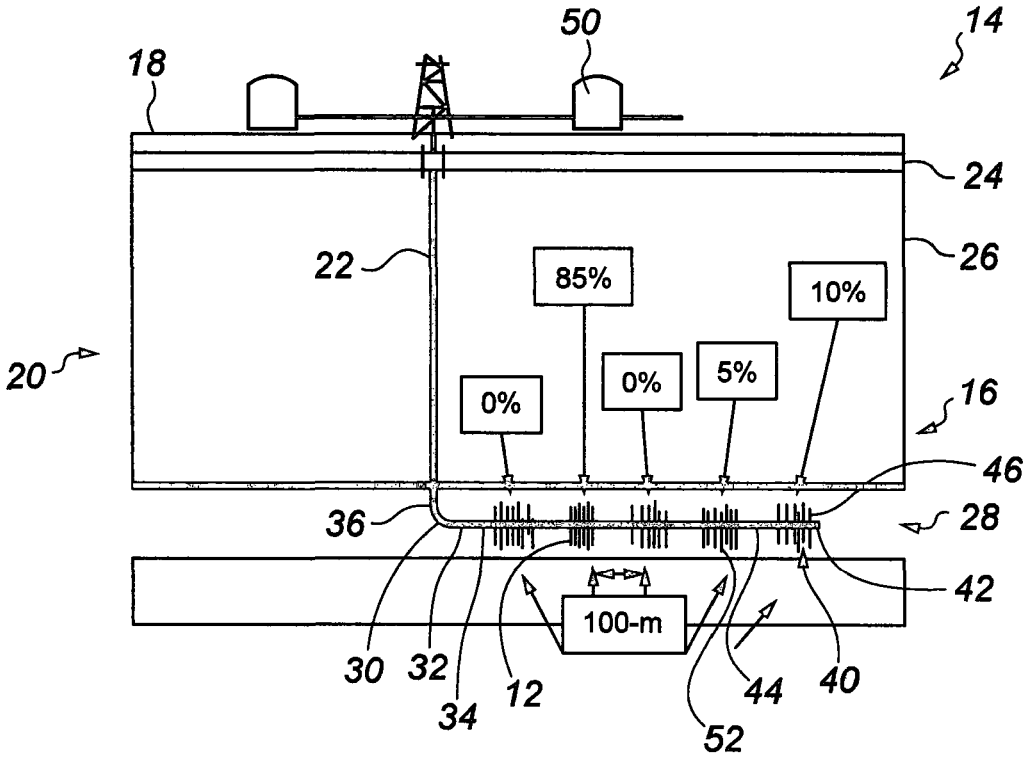
FIG. 2 is a schematic illustration of a well stimulated by hydraulic fracturing according to the prior art.

Referring to FIG. 1, there is illustrated a flow chart providing a methodology, generally indicated by reference numeral 10, for determining the presence of hydrocarbon-filled natural fractures with sufficient lateral extension 12 in a well 14, as illustrated in FIG. 2, in which stimulation by hydraulic fracturing 16 is to be carried out, according to an embodiment of the present invention.

At FIG. 2 there is illustrated a well 14 stimulated by hydraulic fracturing 16 according to the prior art. Well 14 has been drilled in the conventional manner from a surface 18 through the earth formations 20. The well 14 is show with an initial vertical wellbore 22 which is drilled through the fresh water protection layer 24 and cap rock 26 to reach an identified shale formation 28. The wellbore 22 is then drilled horizontally to access a maximum available volume of the shale formation layer 28. In completing the well 14, tubing 30 will have been inserted into the borehole 36 at the shale formation 28, the tubing 30 being cemented in place creating a barrier in the form of a cement sheath between the outer surface 32 of the tubing and the inner surface 34 of the borehole 36. At surface 18, there will be a wellhead 38, which provides a conduit for entry and exit of the wellbore 22.

With the well 14 completed, a first interval 40 is selected. The first interval 40 is typically at the far end 42 of the drain length 44. The first interval 40 is perforated to provide access between the shale formation 28 and the inside 46 of the tubing 30. Such exposure of the formation 28 allows a frac job 48 to be performed.

In the description herein we will consider a completion where the tubing is cemented in place providing a cement sheath which is perforated to expose the formation. Those skilled in the art will recognise that there are other completion methods available providing alternative ways of exposing the formation to the conduit of the production tubing. External packers may also be deployed to isolate each interval and production zone from its neighbours. The formation may be exposed by opening valves or moving sliding sleeves to expose slotted sections of the production liner (i.e. a perforated liner) to allow passage of fluids between the formation at an interval and the inner conduit of the production tubing.

In a typical frac job 48, water or viscosified water in the form of a gel is injected at a relative high initial rate, say 10 bpm. The pumping rate is ramped up in steps of around 20 bpm to achieve a maximum pumping rate of 100 to 200 bpm. This stepped approach is used to shock the formation and open the natural fractures. At this high pumping rate, a proppant is then added to the water, to fill the fractures, keeping them open for production. The proppant is sand or engineered ceramic particles which are sized to provide support while also allowing flow of hydrocarbons i.e. shale oil and/or gas. Pumping is continued until the supply of proppant is exhausted or screen out occurs as you have run out of pump pressure.

Following the frac job 48, the first interval 40 is then plugged 54 to block access to the formation 28. A second interval 52 is then perforated. The second interval 52 is spaced apart from the first interval 40, 100 m may be a typical separation distance, and located downstream of the first interval 40.

A frac job 48 is performed in the same manner on the second interval 52 and the process of plugging then perforating and stimulating by performing a frac job on subsequent intervals is repeated along the drain length 44. Though only a few intervals are illustrated in FIG. 2, 30 to 40 intervals are more common to ensure maximum extraction of available hydrocarbons.

At the end of the process, the entire well is then opened to production. The pumped fluid is back produced followed by hydrocarbon flow.

As indicated in FIG. 2, the quantity of hydrocarbons 50 produced by each interval varies greatly. It is known to those skilled in the art that up to 50% of the intervals will not produce any hydrocarbons 50.

This means that 50% of the product costs in proppant and chemicals is waste. On a typical North American well this represents around 20% of the completion costs. Indeed as water has to be brought to site for the frac job, time spent on each frac job and in handling and blending the proppant, undertaking hydraulic fracturing on the unproductive intervals wastes 30% of the completion costs.

We can alternatively consider that if a method could be found to identify the intervals having hydrocarbon-filled natural fractures with sufficient lateral extent to allow significant future hydrocarbon production, then this waste could be saved and the completion costs for the well could be reduced by around 30%.

Referring again to FIG. 1 here is shown a methodology according to the present invention which illustrates this. On exposing a formation 58 at an interval 40, a test 56 is undertaken which provides an indication of whether there are hydrocarbon-filled natural fractures with sufficient lateral extension 12 in the interval 40. If the answer is 'YES' 60, then the intended frac job 48 can be performed as planned before moving to the next interval. If the test 56 gives an answer of 'NO' 62, then the intended frac job is aborted. Thus saving time and costs in performing a frac job which will not produce any hydrocarbons.

The test 56 is repeated on the next interval 52 and so on throughout the drain length of the well 14, with each interval being perforated and plugged when the answer is 'YES' 56 and just plugged when the answer is 'NO'. When the final interval is tested and a frac job 48 performed if the answer is 'YES' 60, the well can be produced by the known techniques as planned.

Figure 3:
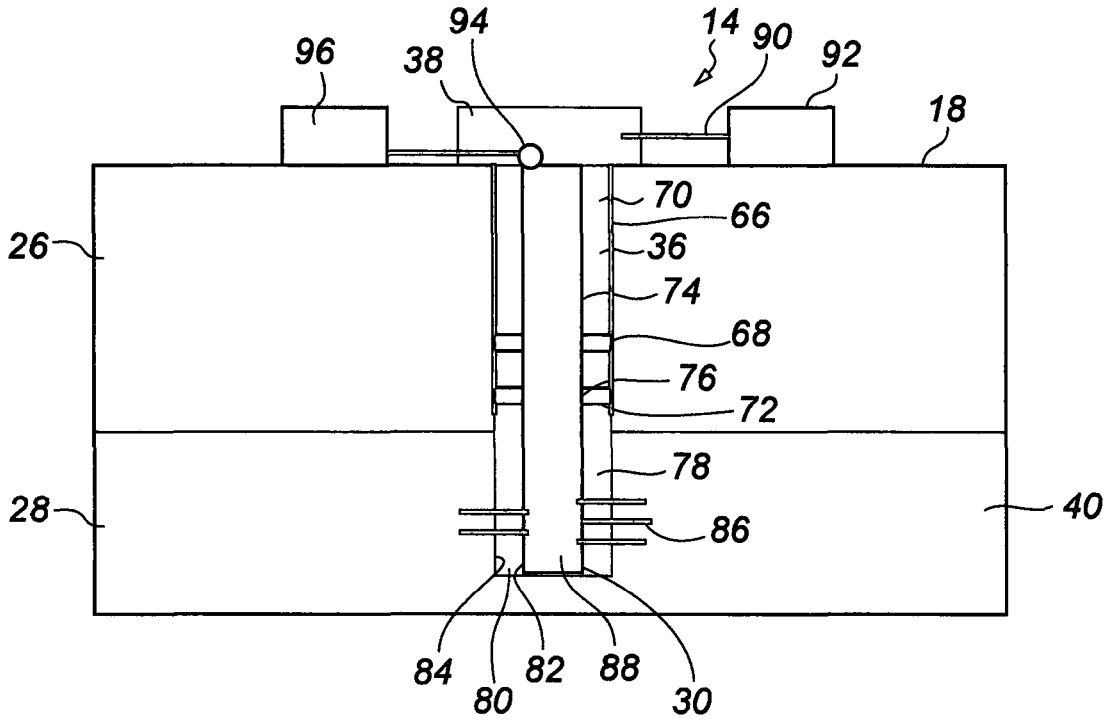
FIG. 3 is a schematic illustration of a well in which the method of the present invention is to be performed.

The requirements to conduct the test 56 at the well 14 are illustrated in FIG. 3. This Figure is a simplified version of FIG. 2 and like parts have been given the same reference numeral to aid clarity. In FIG. 3, the well 14 is shown as entirely vertical with a single interval 40, but it will be realised that the well 14 would be effectively horizontal in practise. Dimensions are also greatly altered to highlight the significant areas of interest. Well 14 is drilled in the traditional manner providing a casing 66 to support the borehole 36 through the length of the cap rock 26 to the location of the shale formation 28. Standard techniques known to those skilled in the art will have been used to identify the location of the shale formation 28 and to determine properties of the well 14.

Production tubing 74 is located through the casing 66 and tubing 30, in the form of a production liner, is hung from a liner hanger 72 at the base 76 of the production tubing 74 and extends into the borehole 36 through the shale formation 28. A production packer 68 provides a seal between the production tubing 74 and the casing 66, preventing the passage of fluids through the annulus 70 therebetween. Cement is pumped into the annulus 80 between the outer surface 82 of the production liner 30 and in the inner wall 84 of the open borehole 36. This cement forms a cement sheath 78 in the annulus 80. When all in place, perforations 86 are created through the production liner 30 and the cement sheath 78 to expose the formation 28 to the inner conduit 88 of the production liner 30. All of this is performed as the standard technique for drilling and completing a well 14 in a shale formation 28.

At surface 18, there is a standard wellhead 38. Wellhead 38 provides a conduit (not shown) for the passage of fluids such as hydrocarbons from the well 14. Wellhead 38 also provides a conduit 90 for the injection of fluids from a pump 92. Gauges 94 are located on the wellhead 38 and are controlled from a unit 96 which also collects the data from the gauges 94. Gauges 94 include a temperature gauge, a pressure gauge and a rate gauge. All of these surface components are standard at a wellhead 38.

In the present invention, the pump 92 is a high pressure accurate low rate pump. The accuracy is required to dispense desired low rates of fluid i.e. below 1 bpm through the conduit 90 into the completed wellbore 36. It will be realised that the volume of the well may necessitate the requirement for multiple pumps to ensure a sufficient pump rate. As we require a low pump rate, it is expected that no more than two pumps will be required. Once the test 56 is complete the pump 92 will be switched to a number of high pressure high rate pumps if a frac job 48 is required.

The gauges 94 may be standard gauges though, for the present invention, the pressure gauge must be able to record data at a high acquisition rate. This rate will be at least 1 Hz, so that a data point can be collected at a rate of at least one point per second. As most gauges are now digital, this may simply require increasing the acquisition frequency on the gauge. The unit 96 may collect the data locally and transmit this to an operating base (not shown) where the data analysis can be performed.

Save for the requirement of a high pressure accurate low rate pump, the test 56 can be performed without any changes required to the drilling and completion of the well 14 and without any intervention.

Thus, in use, referring to FIGS. 1 and 3, once an interval 40 has been perforated to expose 58 the formation 28, fluid is pumped into the wellbore 36 at a low first flow rate 98. The fluid will preferably be water but may also be viscosified water (gel) as is available at the site and used for the initial stage of the intended frac job 48. In this way, no additional special fluids are required for the test 56. As the fluid is pumped into the wellbore 36, the pressure 100 and accumulated volume 102, measured from the pressure and rate gauges 94, is collected at the unit 96. This data provides a pressure response trace 104.

The first fluid flow rate 98 is selected to be at a value much lower than that used for the intended frac job 48. Typically the first fluid flow rate 98 will be below 1 or 2 bpm. Flow rates for the intended frac job 48 are more typically 20 to 200 bpm. The fluid flow rate is maintained at the first flow rate 98 for a period of time. The time selected is sufficient to obtain a suitable trace 104 for analysis and limits the accumulated volume 102 to between 10 and 100 bbl (barrels). The pressure 100 is recorded at a data acquisition rate of 1 Hz. This provides a data point every second. In the intended frac job 48, data acquisition rates more typically record data at 5 minute intervals though some systems can record at 5 second intervals.

Figure 4:
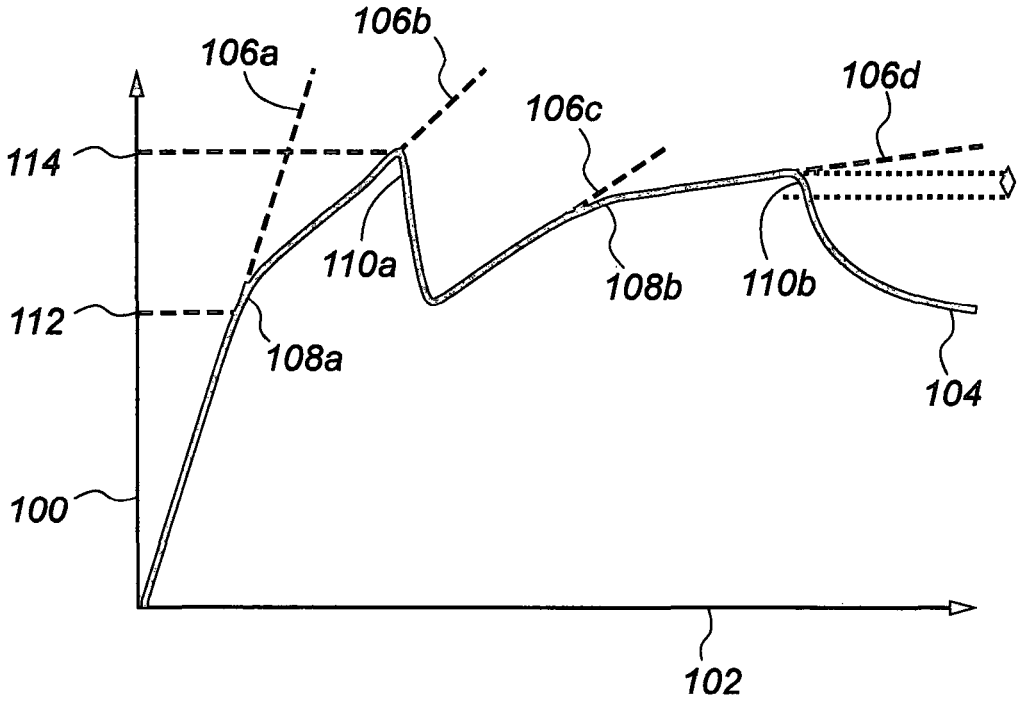
FIG. 4 is a pressure response trace of pressure against accumulated volume of injected fluid following the methodology of the present invention.

Referring to FIG. 4, there is illustrated an example pressure response trace 104 for a test 56 performed at an interval 40 on a well 14 in which a frac job 48 is intended. The trace 104 is a plot of pressure 100 recorded at the wellhead 38 against accumulated volume 102 of injected first fluid. The accumulated volume 102 is determined from the rate measurement at the gauges 94. It is assumed that there is no friction loss, which is reasonable considering the low injection rates used.

The combination of a very low pump rate and a high data collection rate provides a pressure response trace 104 showing a series of slopes S1 to Si 106, with possible kinks 108 and/or dips 110. In the trace 104 of FIG. 4, here is an initial slope, S1, 106*a*. We then see a kink 108*a*, which defines a first pressure value PLOT 112. The kink 108*a* leads to a second slope, S2, 106*b* whose gradient is not as steep as that for S1, 106*a*. At the end of the second slope S2 106*b* we have a dip 110*a*, with the pressure value at the start of the dip 110*a* defining a second pressure value PBD 114. There is then a further third slope S3 106*c* of increasing pressure, which terminates in a kink 108*b* to provide a further slope S4 106*d*. There may be further slopes Si, with each slope having a smaller gradient than the preceding. A final dip 110*b* is seen which represents the pump 92 being switched off and the test 56 being complete.

The slopes 106, kinks 108, dips 110, and first and second pressure values 112,114 are considered as the characteristic elements of the trace 104. While the trace 104 shows all the characteristic elements, it will be appreciated that the presence or absence of these elements can be used for interpretation, as can their position and values. Further, values of some known parameters which will already be interpreted for the well 14 are also used for the analysis.

In the analysis, the characteristic elements are identified and comparisons made. Firstly a comparison is made of the compressed volume which is calculated using slope S1, with the known well volume. A comparison is also made between the first pressure value, PLOT, with the expected minimum horizontal stress. The presence or absence of the second pressure value PBD shown by a sudden dip is considered. The presence or absence of a kink before the first pressure value, PLOT is determined. Also the number and gradient of subsequent slopes S2 to Si are evaluated. The combination of these parameters and analyses provide an indication as to whether a sweet spot has been perforated and hydrocarbon-filled natural fractures are present in the interval. We can also determine if the cement sheath is of good enough quality to sustain the intended frac job.

A simple analysis shows that characteristic elements which are indicative of the presence of a sweet spot are the initial kink at PLOT providing the second slope S2, the absence of breakdown i.e. a dip at PBD and a series of slopes whose gradient is zero i.e. the slopes are horizontal. The presence of the dip and second pressure value PBD together with slopes of decreasing but non-zero gradient, is indicative of a lack of a sweet spot.

Figure 5:
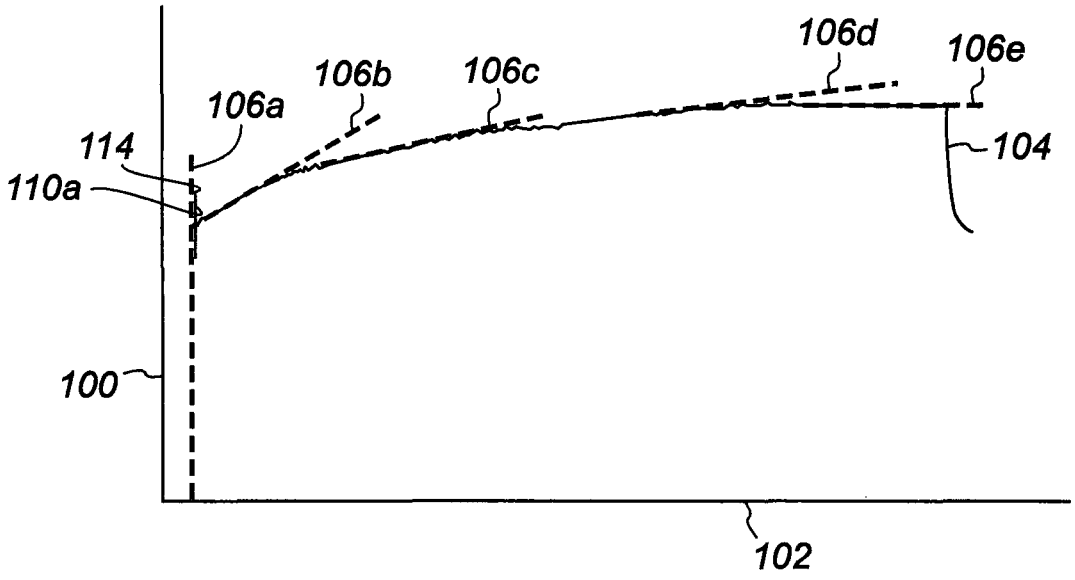
FIG. 5 is a pressure response trace taken on an interval of a well identifying the absence of a sweet spot and there being no hydrocarbon-filled natural fractures with sufficient lateral extension at that interval.

Referring to FIG. 5, there is illustrated a pressure response trace 104 from an interval 40 of a well 14 in which the presence of a sweet spot of hydrocarbon-filled natural fractures is not present. Like parts to those of FIG. 4 have been given the same reference numeral to aid clarity. In this well 14, the first fluid pump rate was 1 bpm and the data acquisition rate was 1 Hz. Response 104 shows a series of five slopes S1 to S5, 106*a-e*. A comparison made of the compressed volume calculated using slope S1 with the known well volume gives a 1:1 correlation, there is a very sudden dip 110*a* with a pronounced second pressure value PBD 114 illustrating breakdown and the slopes S1 to S5, 106*a-e* are a series of decreasing gradients until they are horizontal at the point at which pumping stops 116. Thus the analysis of these characteristics combine to indicate that there is no sweet spot and an absence of hydrocarbon-filled natural fractures. In this case, the intended frac job should be aborted with the products and time saved. The interval should be plugged and perforation of the next interval begun.

Figure 6:
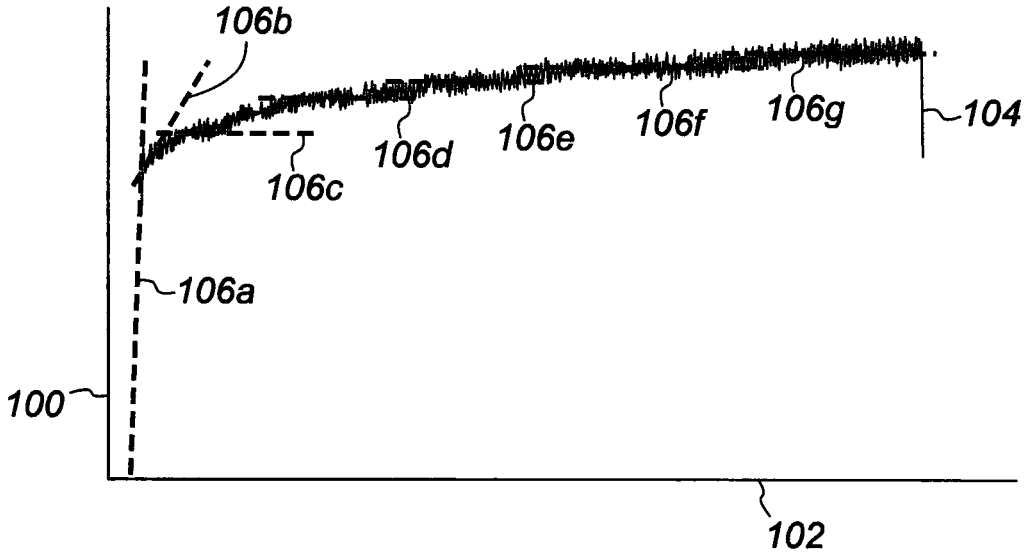
FIG. 6 is a pressure response trace taken on an interval of a well identifying the presence of a sweet spot and there being hydrocarbon-filled natural fractures with sufficient lateral extension at that interval.

In the alternative, we refer to FIG. 6 which illustrates a pressure response trace 104 from an interval 40 of a well 14 in which a sweet spot is present. Like parts to those of FIG. 4 have been given the same reference numeral to aid clarity. In this interval 40, the first fluid pump rate was 0.34 bpm and the data acquisition rate was 1 Hz. Response 104 shows a series of at least seven slopes S1 to S7, 106*a-g*. A comparison made of the compressed volume calculated using slope S1 with the known well volume gives a 1:1.5 correlation, there is no PBD and slopes S1 to S7 show a series of flat behaviours i.e. gradients near zero. From this we conclude that a sweet spot is present and that natural fractures with sufficient lateral extension are present in the interval.

Additionally, the number of horizontal slopes and their corresponding pressures may be back analysed to gain an indication of the dip of the fracture families encountered at the interval.

Figure 7B:
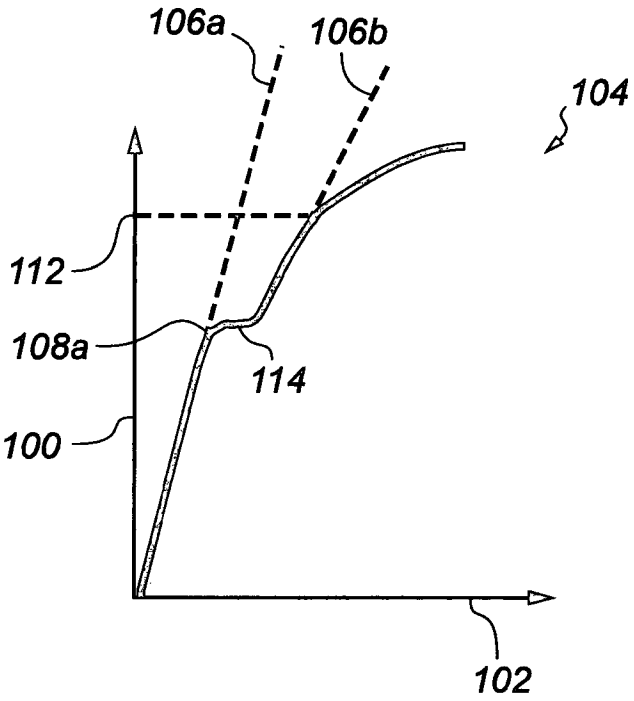
FIGS. 7(*a*) and (*b*) are pressure response traces illustrating a (a) good and (b) bad barrier at the interval.
Figure 7A:
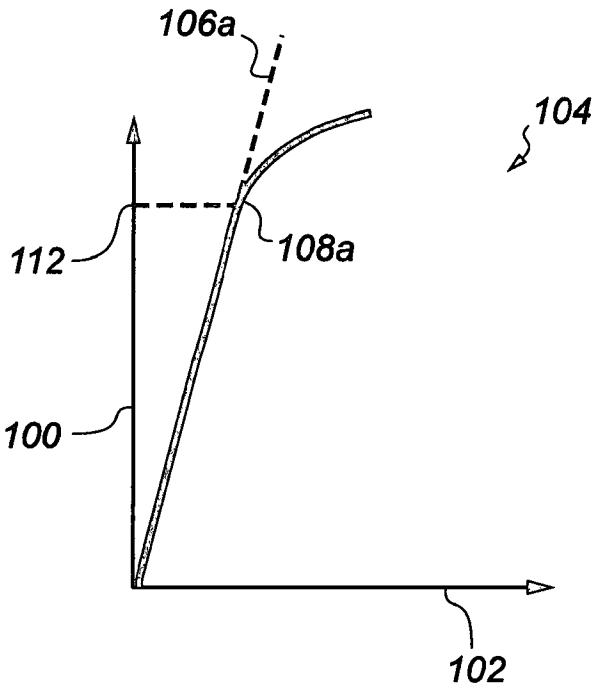

The pressure response trace 104 can also be used to indicate the quality of the barrier i.e. cement sheath, external packer, etc. It is best illustrated with the aid of FIGS. 7(*a*) and (*b*). At FIG. 7(*a*) the first portion of a pressure response trace 104 is shown. Like parts to those of the earlier Figures have been given the same reference numerals to aid clarity. In FIG. 7(*a*), the pressure response trace 104 follows a straight line as slope 106*a* to a kink 108*a* indicating a non-linearity in the trace 104 at around PLOT 112. As a comparison of the compressed volume calculated using slope S1 with the known well volume gives a correlation greater than or equal to one and the kink 108*a* is around PLOT 112, as expected, this provides an indication that the barrier is of sufficient quality and strength to withstand the intended frac job 48.

In contrast, reference is made to FIG. 7(*b*), with like parts again having the same reference numerals as the earlier Figures to aid clarity. The trace 104 on FIG. 7(*b*) begins as a straight line with slope 106*a* indicating a correlation greater than or equal to one with the compressed volume to well volume. However, before reaching a pressure of PLOT 112, there is a breakdown 114, and the following second slope 106*b* has a correlation significantly greater than one. This indicates a sudden pressurised volume increase and a loss of barrier integrity. In this case, the trace 104 shows a bad cement job or the occurrence of packer-by-pass.

Returning to FIG. 1, the methodology 10 demonstrates the use of the test 56 in a standard well 14 in which stimulation by hydraulic fracturing 16 is to be carried out. With a completed well 14 as shown in FIG. 3, the shale formation 28 is exposed 58 at an interval 40. The test 56 is then carried out. A first fluid is pumped at a low first rate 120 and a pressure response trace 140 is collected at a high acquisition rate 122 via gauges 94 at the wellhead 38. The trace 140 is analysed 118 to determine the presence of hydrocarbon-filled natural fractures with sufficient lateral extension 124 in the interval 40. The analysis 118 is described with reference to FIGS. 4 to 6.

In the determination 124, if the answer is 'YES' 60, that there are hydrocarbon-filled natural fractures with sufficient lateral extension 12 in the interval 40, then the intended frac job 48 is performed as planned. If the test 56 gives an answer of 'NO' 62, predicting that there is no sweet spot and no hydrocarbon-filled natural fractures with sufficient lateral extension 12 present then the intended frac job is not carried out. Thus time and materials are saved in not performing a frac job.

The interval 40 is plugged 54 and, if it is not 126 the last interval 128, work moves on to the next interval 52. The methodology 10 is then repeated for the next interval 52 and can be repeated for the required number of intervals in the well 14. At the last interval 128, the hydrocarbons 50 are produced 64.

As we travel through the methodology 10 from the top of FIG. 1 towards the bottom of FIG. 1, each step will incur time and costs. Thus being able to stop the methodology after the YES/NO decision boxes 60,62 eliminates the time and costs to perform a frac job 48. As known to those skilled in the art, a typical well with multiple intervals may have 50% of these intervals not containing hydrocarbon-filled natural fractures with sufficient lateral extension 12 and thus in half the cycles through the methodology 10, time and costs are saved by having knowledge of the 'NO' 62 test 56 result. The frac job 48, plugging 54 and perforating an interval to expose the formation 58, and the production 64 of hydrocarbons 50, are all identical steps to those carried out in the prior art as described with reference to FIG. 2.

It should be noted that the methodology 10 of the present invention is designed to pump fluid into a well at a rate which does not shock the wellbore but merely obtains an initial response to a pressure wave. The pressure and rate are selected with the intention of measuring the flow capacity around the injected zone (yes or no) through induced and/or natural fractures.

The principle advantage of the present invention is that it provides a method of determining the presence of hydrocarbon-filled natural fractures of sufficient lateral extension in a well in which stimulation by hydraulic fracturing is to be carried out so as to prevent the need to carry out a frac job when such fractures are not present in an interval.

A further advantage of the present invention is that it provides a method of determining the presence of hydrocarbon-filled natural fractures of sufficient lateral extension in a well in which stimulation by hydraulic fracturing is to be carried out which can reduce the completion costs of a well by up to 30%.

A yet further advantage of the present invention is that it provides a method of determining the presence of hydrocarbon-filled natural fractures of sufficient lateral extension in a well in which stimulation by hydraulic fracturing is to be carried out which does not require additional specialist chemicals or intervention of the well.

Modifications may be made to the invention herein described without departing from the scope thereof. For example, it will be appreciated that some Figures are shown in an idealised form and that interpretation of the pressure response trace may require a valued judgement in order to provide a determination of the presence of hydrocarbon-filled natural fractures sufficient lateral extension.

I claim:

1. A method of determining a presence of hydrocarbon-filled natural fractures in a well in which stimulation by hydraulic fracturing is to be carried out by a method comprising steps of:

(a) completing the well;

(b) selecting a first interval at a far end of a drain length of the well;

(c) perforating the first interval to expose a formation to provide access between the formation and inside of a completion tubing;

(d) carrying out a frac job at the first interval;

(e) plugging the first interval to block access to the formation;

(f) selecting a further interval spaced apart from a previous interval;

(g) perforating the further interval to expose the formation to provide access between a shale formation and the inside of the completion tubing;

(h) carrying out the frac job at the further interval;

(i) plugging the further interval to block access to the formation;

(j) repeating steps (f) to (i) along the drain length of the well; and (k) opening the well up to production;

characterised in that:

at steps (c) and (g), comprising the additional steps of:

(i) exposing the formation at the first interval and the further interval, respectively;

(ii) pumping a first fluid at a first rate into the well, the first rate being lower than a pump rate of the frac job;

(iii) collecting a pressure response trace of pressure versus time at a first data collection rate measured at a gauge located at a wellhead of the well, the first data collection rate being higher than a data collection rate of the frac job;

(iv) from the pressure response trace determining the presence of hydrocarbon-filled natural fractures at the first interval and the further interval, respectively; and (v) omitting step (d) and (h), respectively, when the presence of hydrocarbon-filled natural fractures are not identified.

2. The method according to claim 1 wherein the first rate is measured by a gauge at the wellhead.

3. The method according to any preceding claim 1 wherein the pressure response trace comprises one or more characteristic elements, the presence and combination of the characteristic elements being used to determine the presence of hydrocarbon-filled natural fractures of sufficient lateral extension at the first interval.

4. The method according to claim 1 wherein the first fluid is pumped at the first rate through a pump which delivers a higher pressure and accurate lower rate than pumps used for the frac job.

5. The method according to claim 4 wherein there are two pumps.

6. The method according to claim 1 wherein the first rate is less than 10 bpm (barrels per minute).

7. The method according to claim 6 wherein the first rate is less than 2 bpm.

8. The method according to claim 7 wherein the first rate is less than 1 bpm.

9. The method according to claim 1 wherein the first data collection rate is at 1 Hz.

10. The method according to claim 1 wherein the data collection rate is between 1 and 10 Hz.

11. The method according to claim 1 wherein the data collection rate is between 10 and 100 Hz.

12. The method according to claim 1 wherein the first rate is held constant for a given time period.

13. The method according to claim 12 wherein the time period is set to limit a volume of fluid pumped into the well to be between 10 to 100 barrels.

14. The method according to claim 1 wherein the method includes the step of determining a quality of barriers on either side of the exposed formation at the interval.

15. The according to claim 14 wherein the step of determining the quality of the barriers is determined by analysis of the pressure response trace.

16. The method according to claim 1 wherein the method is repeated at further intervals along the drain length of the well.

* * * * *